US005867839A

United States Patent [19]

Lawlor

[11] Patent Number: 5,867,839

[45] Date of Patent: Feb. 9, 1999

[54] ATHLETIC SOCK GARTER AND METHOD OF USING SAME

[76] Inventor: Michael R. Lawlor, 9856 Aquilla Rd., Bloomington, Minn. 55438

[21] Appl. No.: 953,694

[22] Filed: Oct. 17, 1997

[51] Int. Cl.[6] ..... A41F 9/00

[52] U.S. Cl. ..... 2/240; 2/303; 2/311

[58] Field of Search ..... 2/240, 303, 306, 2/311, 312, 318, 321, 322, 335, 920, 22, 23, 338, 269; 450/100, 106, 110, 111, 112, 136

[56] References Cited

U.S. PATENT DOCUMENTS

| | | | |
|---|---|---|---|
| 233,414 | 10/1880 | Hays et al. . | |
| 546,420 | 9/1895 | Dreyfus . | |
| 875,486 | 12/1907 | Askins . | |
| 1,599,011 | 9/1926 | Hohn . | |
| 1,834,046 | 12/1931 | Brooks . | |
| 2,021,940 | 11/1935 | Lathrop . | |
| 2,669,726 | 2/1954 | Meisel | 2/269 X |
| 2,896,220 | 7/1959 | Kenny | 2/319 |
| 3,086,529 | 4/1963 | Munz et al. . | |
| 3,426,363 | 2/1969 | Girard . | |
| 3,501,774 | 3/1970 | Norman | 2/321 |
| 4,273,130 | 6/1981 | Simpson . | |
| 4,384,583 | 5/1983 | Speelman et al. . | |
| 4,501,027 | 2/1985 | Olsson | 2/321 |
| 4,509,214 | 4/1985 | Shea | 2/322 |
| 4,527,289 | 7/1985 | Shea | 2/322 |
| 4,782,535 | 11/1988 | Yewer, Jr. et al. | 2/321 |
| 4,825,475 | 5/1989 | Smart . | |
| 4,999,853 | 3/1991 | Tanner | 2/321 |

OTHER PUBLICATIONS

Sammons Orthopedic and ADL Products catalogue 1995.

*Primary Examiner*—Michael A. Neas
*Assistant Examiner*—Shirra L. Jenkins
*Attorney, Agent, or Firm*—Allen, Dyer, Doppelt, Milbrath & Gilchrist, P.A.

[57] ABSTRACT

An athletic sock garter and method of using a garter are provided which preferably include an elongate strap arranged for encircling a portion of a sock wearer's leg when an athletic sock is positioned thereon so that an inner surface of the elongate strap abuttingly contacts a leg portion of the sock. The elongate strap has at least a portion thereof formed of elastic material. An adjustable fastener is connected to the elongate strap for adjustably fastening the elongate strap about the leg portion of the sock when positioned on a wearer's leg. The adjustable fastener preferably includes a ring member connected to a first end of the elongate strap, a pile fastener material secured to a portion of the outer surface of said elongate strap, and a mating hook fastener material secured to a portion of the outer surface of the elongate strap extending from closely adjacent a second end thereof toward the first end of the elongate strap. Insertion of the second end of the elongate strap through the ring member and folding the hook fastener portion of the elongate strap so as to overlie and positionally align with the pile fastener portion for matingly fastening therewith provides adjustable positioning of the elongate strap around the leg portion of the sock.

27 Claims, 6 Drawing Sheets

L
31
41
20
30
28
25
B
22

L
30
31
37
41
28
F
35
36
40

30
31
39
37
51
50
32
40
43
41
36
35
33

6
37
39
34
31
33
38
35
36
42
46

37
34
31
32
51
35
42
36
44
45

37
34
31
33
32
34
36
41

30'
37'
11
39'
34'
38'
34'
33'
35'
38'
34'
41'
42'
44'
43'
36'
46'
11

30'
37'
34'
34'
35'
32'
34'
36'
41'
46'
42'
44'
43'

37'
30
39'
34'
38'
34'
35'
34'
38'
36'
34'
41'

30''
39''
37''
16
34''
33''
31''
35''
38''
41''
36''
34''
44''
43''
42''
46''
16

30''
37''
34''
32''
31''
35''
36''
41''
42''
44''
46''
43''

37''
30''
39''
34''
31''
38''
41''
34''
36''

ATHLETIC SOCK GARTER AND METHOD OF USING SAME

FIELD OF THE INVENTION

The present invention relates to the fields of entertainment and athletics and, more particularly, to athletic hosiery.

BACKGROUND OF THE INVENTION

Over the years, athletic hosiery has developed to a highly specialized industry. Athletic hosiery includes socks, footlets, and various customized footwear for athletic purposes. Athletic hosiery often has specialized as well into developing, for example, particular types of socks for certain athletic endeavors. Particular types of socks exist for basketball, soccer, hockey, football, baseball, trekking, tennis, golf, and racketball. These socks are often either a knee- high variety, a calf-high variety, or footlet variety.

A recurring problem exists, however, particularly with knee-high and calf-high type athletic socks which are often used in sports such as soccer or football. The leg of the sock has trouble staying up over the calf of the leg especially during heavy running, jumping, sliding, or other exercises where the lower extremity or leg musculature is used. Elastic in the leg of the sock often deforms or stretches out of shape quickly from the exercise or from multiple machine washings. The movement of the calf muscle itself and the body of the user also often cause the leg of the sock to slide off of the wearer's calf or collapse around the wearer's ankle. Perspiration, various wet weather conditions or playing environments, and physical contact of the legs with other athletes additionally add to the collapse of the leg of the sock or cause the leg of the sock to slide off of the calf.

To remedy the situation, athletic sock wearers often use tape to support the leg portion of the sock. Because of the flexing and movement of the leg muscles of the sock wearer during an athletic event, however, some tape cannot be re-adjusted once it has been applied. The tape then often has to be reapplied several times during each game. In order to support the sock, tape is typically applied too tightly which can also cut off or greatly inhibit effective blood circulation to the legs and feet of a wearer. Tape further can have problems when it looses its adhesiveness during certain types of wet and/or cold weather.

Rubber bands also have been used for numerous years around the leg portion of a sock to support the leg portion of the sock on the wearer's leg. A wearer, for example, slips the loop or band of rubber over the toe portion of the sock, advances the loop up the leg portion of the sock, and advances the loop to upper peripheries of the leg portion of the sock. Also like tape, however, rubber bands cannot be readily adjusted, often break, and additionally can cut off or greatly inhibit blood circulation to an athlete's legs and feet.

Garters have conventionally been used for ladies knit hose, dress socks, and uniform-type socks over the years. These garters include a strap having a pair of fasteners for securing respective ends of the strap. Examples of such garters can be seen in U.S. Pat. No. 3,501,774 by Norman titled "Garter" and U.S. Pat. No. 1,599,011 by Hohn titled "*Sock Suspender, Garter, Or The Like*." Conventional garters, however, have several problems. Some of these garters are not constructed and are not practical for use even with socks, e.g., only ladies knit hose. These garters also, for example, can be secured tightly around a user's leg and cut off blood circulation to the user's lower extremities. This is particularly important in athletic events where the legs of the user are heavily used, e.g., soccer, baseball, football.

These conventional garters also have not been generally accepted for athletic use for a variety of reasons including that these conventional garters fail to account for heavy athletic use where perspiration, inclement weather conditions, heavy calf muscle flexing, and heavy physical contact regularly occur. Additionally, different athletes have different sized calf muscles or legs and a different sized garter is often required for each person. Because during athletic use the straps of the garters can be stretched out of shape or deformed with little or no recovery characteristics, the construction of the conventional garter is not practical or reliable for athletic events. Further, during active athletic events and in sync with the activity, athletes often need to quickly and yet securely make adjustments to a garter because of the perspiration, muscle flexing, and other changes in the position of the sock and movement of the leg.

OBJECTS AND SUMMARY OF THE INVENTION

With the foregoing in mind, it is an object of the present invention to provide an athletic sock garter and method of using a garter that maintains the garter in a secure position on a user's leg even during heavy athletic use.

It is also an object of the present invention to provide an athletic sock garter that compensates for the heavy use of the calf muscle during athletic events and inhibits slippage of the garter when engaging or abuttingly contacting a wearer's sock.

It is an additional object of the present invention to provide a one-size-fits-all athletic sock garter that readily adapts and adjusts to various legs of athletes.

It is another object of the present invention to provide an athletic sock garter, combination of sock and garter, and methods that can readily be positioned on a leg of a user, that can readily and quickly be adjusted to comfortable positions even during the athletic event itself, and that effectively keep the leg of a user's sock upright and secure about the user's leg.

It is also another object of the present invention to provide an athletic sock garter, combination of sock and garter, and methods that are re-useable, long-lasting, and improve recovery characteristics during repeated use.

It is still another object of the present invention to provide an inexpensive, easy to manufacture, and yet effective garter for athletic purposes that readily adjusts to various sizes of a user's leg and/or calf muscle.

It is yet another object of the present invention to provide a comfortable and readily adjustable athletic sock garter that can be quickly and securely adjusted during athletic events and in sync with the athletic activity without the requirement of customizing a garter for each athlete.

It is a further object of the present invention to provide an athletic sock garter that does not compromise effective blood circulation to the legs and yet maintains the leg of a sock in a secure position about the user's leg.

More particularly, an athletic sock garter according to the present invention preferably includes an elongate strap arranged for encircling a portion of a sock wearer's leg when an athletic sock is positioned thereon so that an inner surface of the elongate strap abuttingly contacts a leg portion of the sock. The elongate strap has at least a portion thereof formed of elastic material. The elastic material preferably has a predetermined range of elasticity so as to provide support for the sock without significantly impeding blood circulation through the leg. Adjustable fastening means is connected to the elongate strap for adjustably fastening the elongate strap about the sock when positioned on a wearer's leg. The adjustable fastening means preferably includes a ring member connected to a first end of the elongate strap, a pile fastener material secured to a portion of the outer surface of said elongate strap, and a mating hook fastener material secured to a portion of the outer surface of the elongate strap extending from closely adjacent a second end thereof toward the first end of the elongate strap. Insertion of the second end of the elongate strap through the ring member and folding the hook fastener portion of the elongate strap so as to overlie and positionally align with the pile fastener portion for matingly fastening therewith provides adjustable positioning of the elongate strap around the leg portion of the sock when positioned on the wearers leg.

The adjustable fastening means and the elastic material of the elongate strap advantageously allow an athlete to make a quick and secure adjustment to the fastening of the garter during or in the heat of an athletic event without significant inactivity or non-involvement by the wearer. The ring member of the adjustable fastening means preferably is formed of a plastic, nylon, or combination plastic and nylon material. A proximal end portion of the plastic ring member can be connected to the first end of the elongate strap and a distal end portion of the plastic ring member can extend inwardly toward the proximal end portion for providing enhanced leverage for a quick, secure, and comfortable adjustment to the fastening of the adjustable fastening means.

The present invention also includes sock slippage inhibiting means connected to the inner surface of the elongate strap for abuttingly contacting and inhibiting slippage of the garter with outer portions of a wearer's sock. The elongate strap preferably has portions thereof formed of a plastic material. The sock slippage inhibiting means, for example, can include an elongate strip of hook material extending lengthwise along the inner surface of the plastic portion of the elongate strap. The slippage inhibiting means advantageously engages or increases the friction resistance of the inner surface of the garter with the outer surface of the sock further enhancing support without additional tension on the strap so that the garter does not readily slip during active use of an athlete's legs.

Additionally, the present invention provides a combination athletic sock and athletic sock garter. The combination preferably includes an athletic sock arranged to be positioned on a wearer's leg. An athletic sock garter is associated with the athletic sock for supporting a leg portion of the sock when positioned on a wearer's leg. The garter includes at least a portion thereof formed of elastic material having a predetermined range of elasticity so as to provide support for said sock without significantly impeding blood circulation through the wearer's leg and adjustable fastening means for adjustably fastening said garter when positioned at a desired location on a wearer's leg.

The present invention also provides methods of using an athletic sock garter for supporting a leg portion of an athletic sock during athletic events where the legs of the wearer are heavily used. A method preferably includes encircling a portion of a sock wearer's leg when an athletic sock is positioned thereon with an elongate strap having a ring member connected to a first end thereof so that an inner surface of the elongate strap abuttingly contacts a leg portion of the sock. A second end of the elongate strap is inserted through the ring member. A hook fastener portion of the elongate strap is folded so as to overlie and positionally align with a pile fastener portion of the elongate strap to matingly fasten therewith. The elongate strap can then be adjustably positioned around the leg portion of the sock when positioned on the wearers leg and adjustably fastened about the sock when positioned at a desired location on a wearer's leg.

Another method of using an athletic sock garter for supporting an athletic sock during athletic events where the legs of the wearer are heavily used preferably includes encircling a portion of a sock wearer's leg when an athletic sock is positioned thereon with an elongate strap having only a portion thereof formed of an elastic material so that an inner surface of the elongate strap abuttingly contacts a leg portion of the sock. The elastic material preferably has a predetermined range of elasticity so as to provide support for the sock without significantly impeding blood circulation through the leg. The elongate strap is adjustably positioned around the leg portion of the sock when positioned on the wearers leg so as to stretch the elastic portion of the elongate strap. The elongate strap can then be adjustably fastened about the sock when positioned at a desired location on a wearer's leg.

The athletic sock garter and methods of the present invention therefore advantageously maintain a leg portion of a wearer's sock in a secure position on the wearer's leg even during heavy athletic use. The garter compensates for the heavy use of the lower extremity or leg musculature during athletic events by use of a combination of an adjustable fastener, elastic material, and inelastic material. The elastic characteristics of the garter advantageously improve recovery characteristics for repeated use by athletes. By having portions of the elongate strap that readily break away such as by cutting or separating, the garter also advantageously provides a one-size-fits-all type garter that readily adapts and adjusts to various legs of athletes. The garter additionally is inexpensive, easy to manufacture, washable, re-usable, and yet an effective garter for these athletic purposes that does not cut off effective blood circulation to the leg of the wearer.

BRIEF DESCRIPTION OF THE DRAWINGS

Some of the objects and advantages of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime (') and double prime (") notation are used to indicate similar elements in alternative embodiments.

Figure 1:
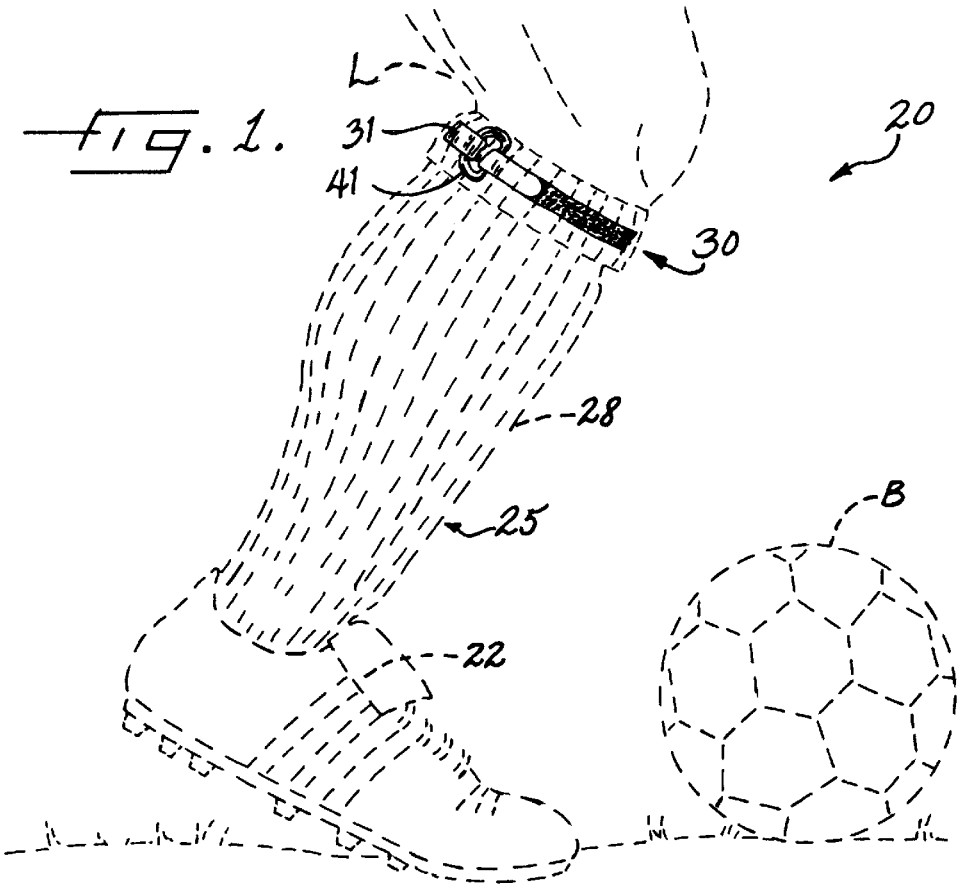
FIG. 1 is an environmental view of a combination sock and garter positioned on a leg of a soccer player according to the present invention.
Figure 2:
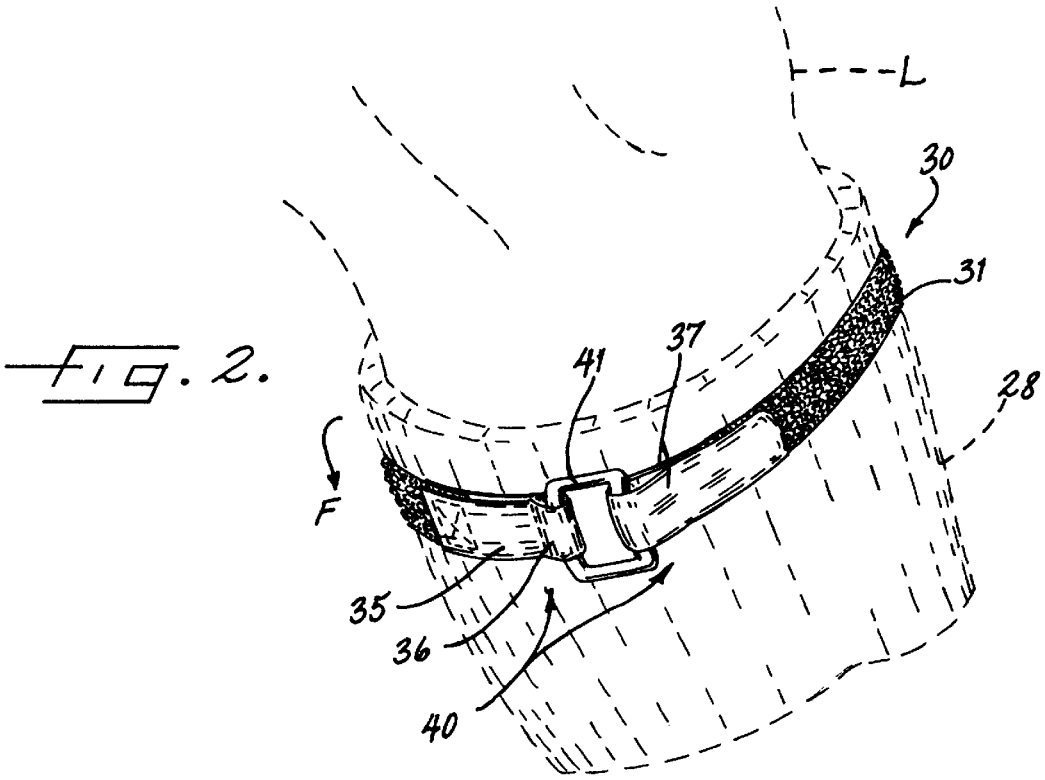
FIG. 2 is an enlarged fragmentary perspective view of an athletic sock garter positioned on a sock and leg of a user according to a first embodiment of the present invention.

FIG. 1 illustrates a combination 20 of an athletic sock 25 and a first embodiment of an athletic sock garter 30 according to the present invention. The athletic sock garter supports a leg portion 28 of the athletic sock 25 during athletic events where the legs of the wearer are heavily used. Examples of these events can include soccer, football, ice hockey, field hockey, rugby, basketball, running, trekking, and lacrosse. FIG. 1 illustrates the leg L of an athlete preparing to strike a soccer ball B with a shoe 22 and illustrates upper peripherals of the leg portion 28 of the sock 25 folded to overlie the garter 30 after the garter 30 has been adjusted and fastened to a desired location. The arrow at F in FIG. 2 illustrates the downward folding of the upper peripheries of the leg portion 28 of the sock 25 so as to overlie the garter 30.

As illustrated, the athletic sock garter 30 preferably has an elongate strap 31 arranged for encircling a portion of a sock wearer's leg when the athletic sock 25 is positioned thereon so that an inner surface 32 of the elongate strap 31 abuttingly contacts the leg portion 28 of the sock 25. Advantageously, the elongate strap 31 preferably has at least a portion thereof formed of an elastic material 35 having a predetermined range of elasticity so as to provide support for the leg portion 28 of the sock 25 for a variety of anatomical circumferences without significantly impeding blood circulation through the leg L of the wearer. To accomplish this result, the elastic material of the elongate strap 31 preferably has a minimum stretch of about 80–90% of the relaxed length without curling, e.g., about 85%, and a full recovery after a maximum stretch. The same elastic portion 35 of the elongate strap 31 preferably is also formed of a rubber material so that the elastic portion 35 of the elongate strap 31 preferably has more rubber material content than either polyester material or nylon material content, but at a minimum in the range of about 42–47% rubber content, e.g., 44% rubber content.

An example of such an elastic and rubber portion 35 of the strap 31 can be seen in the waistband of many types of underwear, briefs, or athletic supporters. These waistbands provide good elastic recovery even after repeated use, after repeated machine washings, and during athletic events wear which often require heavy use of the legs. These waistbands also provide a snug fit and yet do not cut off effective blood circulation to lower extremities of the body. The elastic and rubber portion 35 of the strap 31, such as illustrated by this example, preferably will not readily fold or curl when stretched, is washable, and will not readily shrink when repeatedly machine washed. The width of the strap, for example, preferably is between about ⅝ths-inch to about 2½ inches, e.g., 1¾ inches, 1½ inches, or 2 inches. Advantageously, the length can be selected so that a particular length and/or width size fits most men, most women, or most children. As described further herein below, one width can also fit all men, women, and children.

A first embodiment of an athletic sock garter 30, as best illustrated in FIGS. 2–6, includes the strap 31 having at least first and second portions. This first embodiment illustrates a garter 30 having three portions connected or joined together along stitch lines 34 at ends thereof. Because the garter 30 is preferably machine washable, can be easy and inexpensive to manufacture, and can be reused numerous times, sewing or stitching, e.g., box stitching, the portions together can advantageously be performed. It will be understood by those skilled in the art, however, that other secure joining or connecting methods, such as ultrasonic bonding, adhesives, or welding, can be used as well according to the present invention. The first portion preferably is formed of elastic material and has an end thereof defining the first end 36 of the strap 31. The elastic material also allows the strap 31 to comfortably conform to the anatomical size and shape of the leg and surrounding muscles even during contraction and expansion of the muscles. As understood by those skilled in the art, the elastic material, for example, can be one or more layers of elastic, i.e., two-layers, forming the first portion as illustrated and described.

The second portion preferably is formed of non-elastic material so that the elongate strap 31 flexibly adjusts to movement associated with a wearer's leg L and allows blood to continue to readily circulate to the wearer's leg L when the garter 30 is positioned thereon. The non-elastic portion of the strap 31 preferably is a plastic material, e.g., a polymeric material, that is cut, extruded, or otherwise formed into the desired portion of the strap 31.

Also, adjustable fastening means, e.g., an adjustable fastener 40, is connected to the elongate strap 31 for adjustably fastening the elongate strap 31 about the leg portion 28 of the sock 25 when positioned on a wearer's leg L. The adjustable fastening means 40 preferably includes a ring member 41 connected to a first end 36 of the elongate strap 31, a pile fastener material 38 secured to a portion of an outer surface 33 of the elongate strap 31, and a mating hook fastener material 39 also is secured to a portion of the outer surface 33 of the elongate strap 31 extending from closely adjacent a second end 37 thereof toward the first end 36 of the elongate strap 31. Insertion of the second end 37 of the elongate strap 31 through the ring member 41 and folding the hook fastener portion 39 of the elongate strap 31 so as to overlie and positionally align with the pile fastener portion 38 for matingly fastening therewith provides adjustable positioning of the elongate strap 31 around the leg portion 28 of the sock 25 when positioned on the wearer's leg L. Although particular illustrated embodiments described herein have the hook and pile fastener material positioned at various locations on the strap 31, 31', 31", it will be understood by those skilled in the art that these positions can vary as long as the adjustable and mating fastening arrangement is provided.

A garter 30, according to the present invention, that has portions formed of material that provide a slick surface or little friction resistance, e.g., plastic or other synthetic materials, when abuttingly contacting the sock 25 often works its way loose or slides down from the calf muscle of the leg L of the wearer thereby allowing the leg portion 28 of the sock 25 to readily slide with it. This problem can also occur when the elastic material of the strap 31 has little recovery such as is found in leg portions of conventional athletic socks. Like leg portions of conventional athletic socks, multiple machine washings, continued use, and the flexing and movement of the muscles of the leg during an athletic event can also cause a conventional garter to act like a sock thereby defeating the purpose of the garter altogether.

Figures 3, 4, 5, 6:
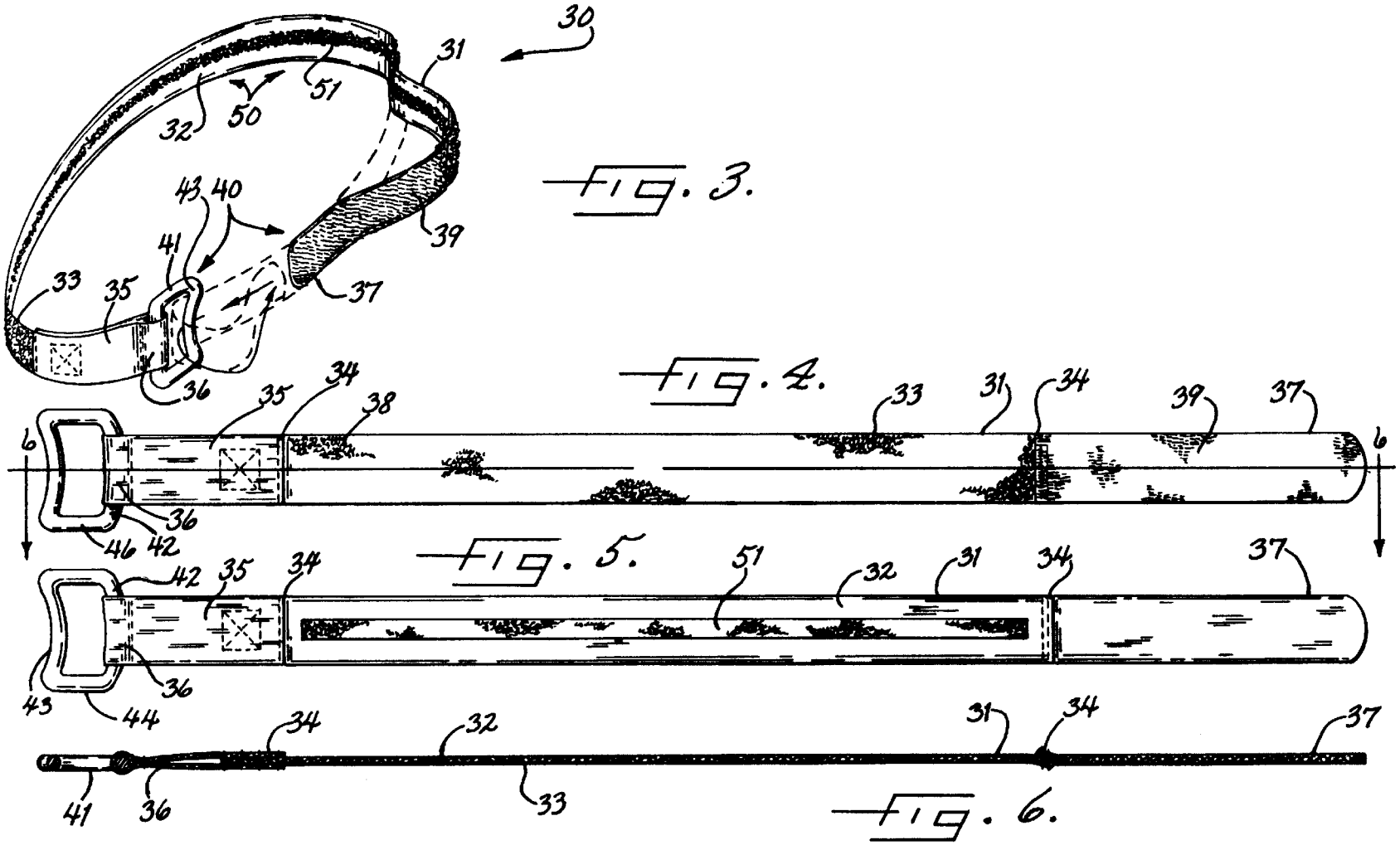
FIG. 3 is a perspective view of an athletic sock garter according to a first embodiment of the present invention.
FIG. 4 is a top plan view of an athletic sock garter according to a first embodiment of the present invention.
FIG. 5 is a bottom plan view of an athletic sock garter according to a first embodiment of the present invention.
FIG. 6 is a transverse sectional view of an athletic sock garter taken along line 6—6 of FIG. 4 according to a first embodiment of the present invention.
Figure 7:
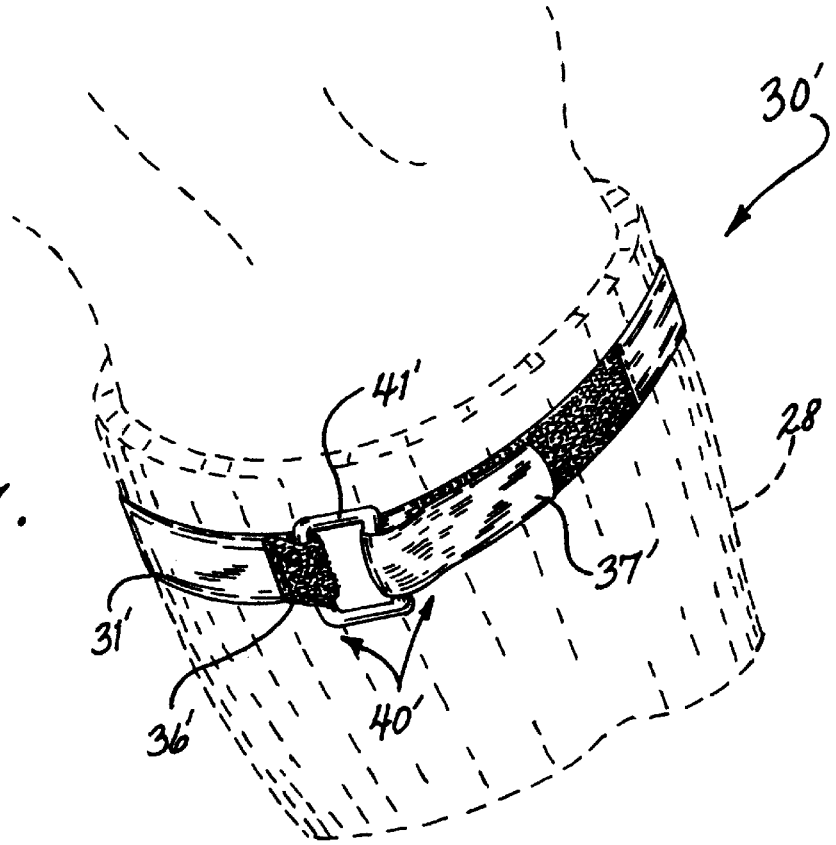
FIG. 7 is an enlarged fragmentary perspective view of an athletic sock garter positioned on a sock and leg of a user according to a second embodiment of the present invention.
Figure 8:
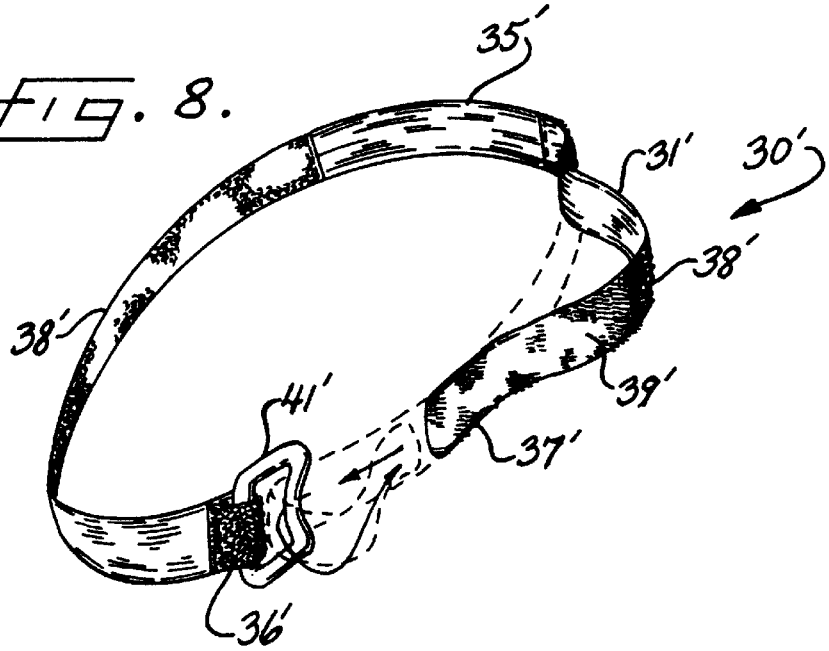
FIG. 8 is a perspective view of an athletic sock garter according to a second embodiment of the present invention.
Figures 9, 10, 11:
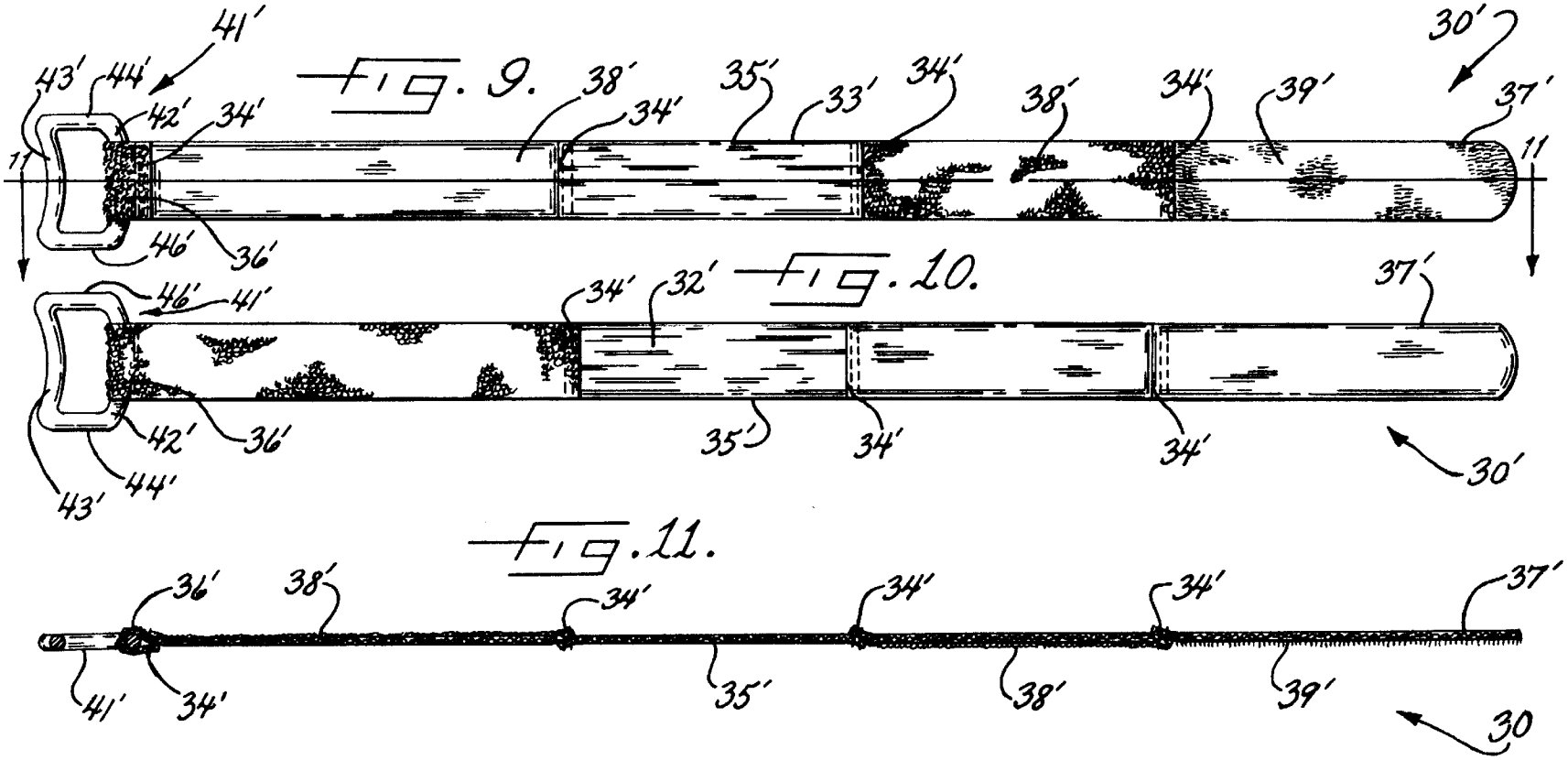
FIG. 9 is a top plan view of an athletic sock garter according to a second embodiment of the a present invention.
FIG. 10 is a bottom plan view of an athletic sock garter according to a second embodiment of the present invention.
FIG. 11 is a transverse sectional view of an athletic sock garter taken along line 11—11 of FIG. 9 according to a second embodiment of the present invention.
Figure 12:
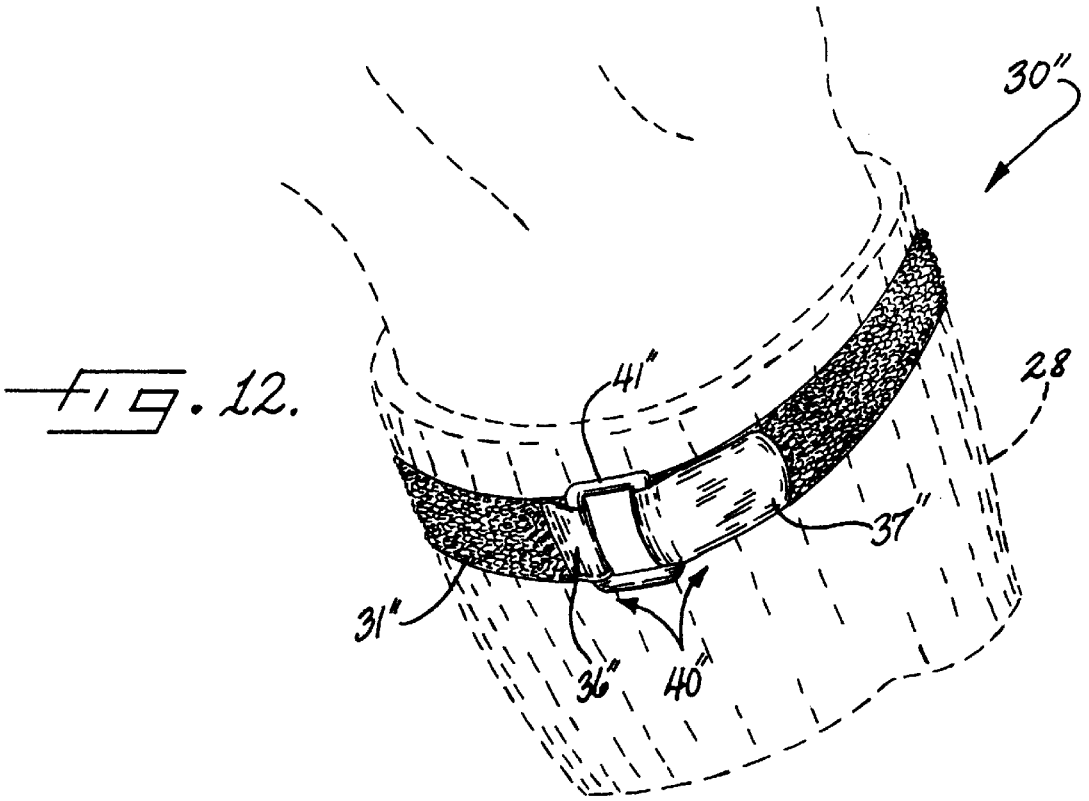
FIG. 12 is an enlarged fragmentary perspective view of a garter positioned on a sock and leg of a user according to a third embodiment.
Figure 13:
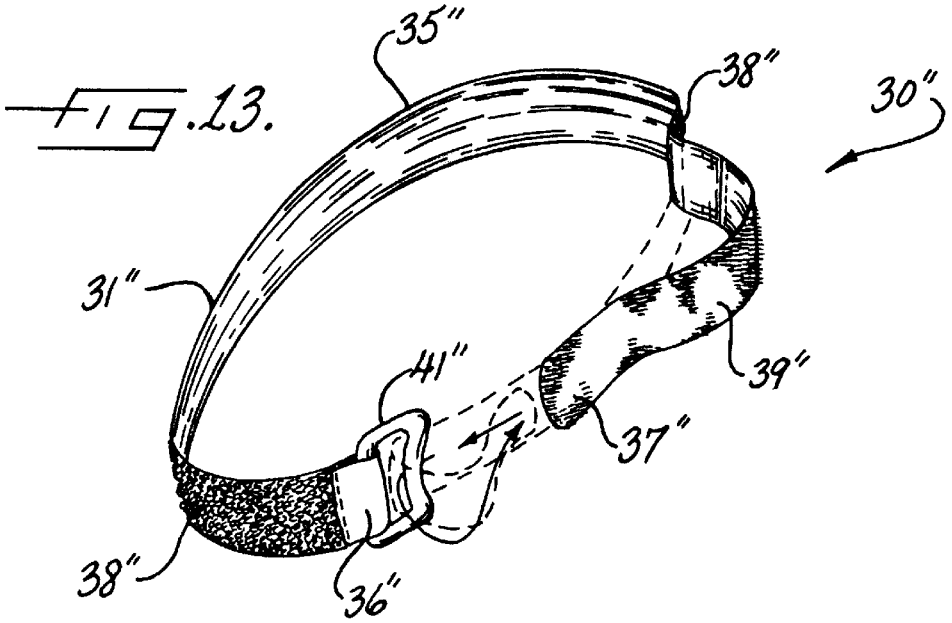
FIG. 13 is a perspective view of an athletic sock garter according to a third embodiment of the present invention.
Figures 14, 15, 16:
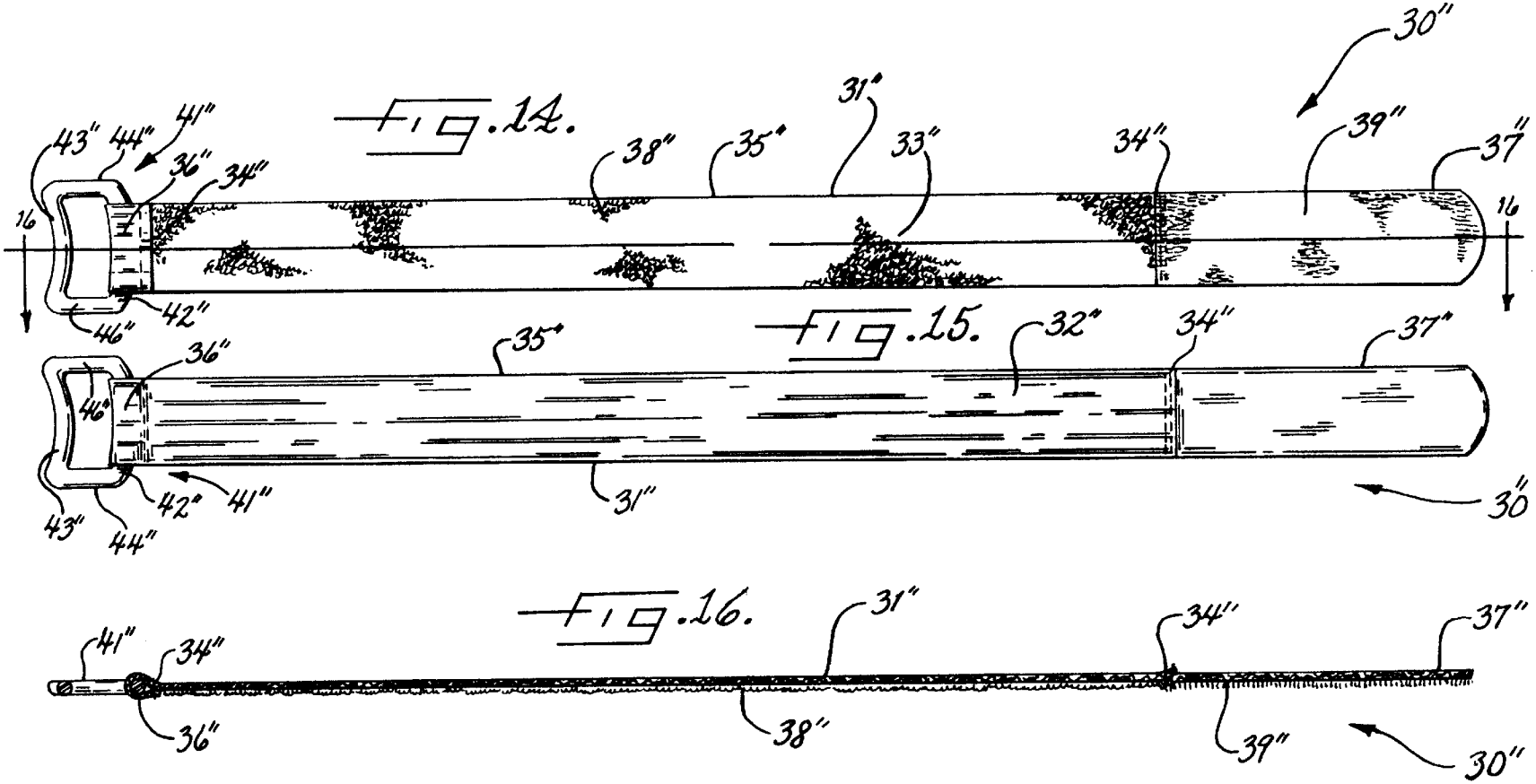
FIG. 14 is a top plan view of an athletic sock garter according to a third embodiment of the present invention.
FIG. 15 is a bottom plan view of an athletic sock garter according to a third embodiment of the present invention.
FIG. 16 is a transverse sectional view of an athletic sock garter taken along line 16—16 of FIG. 14 according to a third embodiment of the present invention.

As best illustrated in FIGS. 3 and 5, the athletic sock garter 30 preferably also advantageously includes sock slippage inhibiting means 50 connected to the inner surface of the elongate strap 31 for abuttingly contacting and inhibiting slippage of the garter 30 with outer leg portions of a wearer's sock 25. Because the elongate strap 31 of the garter 30 preferably has at least portions thereof formed of a plastic material, the sock slippage inhibiting means 50 preferably is an elongate strip 51 of hook material extending lengthwise along the inner surface 32 of the plastic portions of the elongate strap 31. This hook material preferably is finer than the hook material used for the adjustable fastener 40. The elongate strip 51 can also be formed of a rubber material, e.g., such as used for a waistband liner in pants. It will further be understood by those skilled in the art that the slippage inhibiting means 50 could extend in only selected portions of the garter 31 or be formed of various other slippage inhibiting materials that abuttingly contact the sock 25.

The ring member 41 of the adjustable fastening means 40 preferably is also formed of a plastic material so that the garter 30 advantageously is more lightweight. A proximal end portion of the plastic ring member 41 is connected to the first end 36 of the elongate strap 31. A distal end portion of the plastic ring member 41 extends inwardly toward the proximal end portion for providing enhanced leverage so that a quick, secure, and comfortable adjustment to the fastening of the adjustable fastening means 40 can readily be accomplished such as during active use. As illustrated, the ring member 41 preferably has an elongate proximal end 42, an elongate distal end 43, and a pair of elongate sides 44, 46. Each of the pair of elongate sides 44, 46 extends between and is connected to the proximal and distal ends 42, 43. The elongate sides 44, 46 preferably extend generally parallel to each other, the proximal end 42 preferably extends outwardly toward the first end 36 of the elongate strap 31, and the distal end 43 preferably extends inwardly toward the proximal end 42 of the ring member 41. The ring member 41 thereby has a generally collapsed D-shape for providing enhanced leverage as described above.

This sturdy collapsed D-shape of the ring member 41 provides a quick, secure, and comfortable adjustment to the fastening of the adjustable fastening means 40 such as when an athlete is in the middle of an athletic event and needs to quickly adjust the garter 30 while monitoring the progress of the event or game. This shape and construction of the ring member 41 provides better leverage to control tightness of the strap 31 when adjustably fastening the garter 30. If desired, the wearer can thereby adjust and fasten the adjustable fastener in sync with the athletic event. The ring member 41, for example, can have a ⅝ths inch, ¾ths inch, or one inch diameter. It will be understood by those skilled in the art, however, that other materials such as metal can also be used to form a ring member according to the present invention. It will also be understood by those skilled in the art that other shaped fasteners that provide the quick and secure adjustment can be used as well.

Additionally, the adjustable fastener 40 of an athletic sock garter 30 according to the present invention can include a removable portion of the elongate strap 31 that can be broken away from the second end 37 thereof so as to define a new second end after the removable portion is broken away so that the length of the strap 31 can be adjusted, e.g., reduced, for various sized legs of wearers thereof. The garter 30 can also include one or more indicia identifiers detachably connected to the elongate strap 31. Examples of the indicia identifiers can be team logos, personal names, uniform designs and colors, and others as understood by those skilled in the art. These indicia identifiers add another commercial aspect to the garter 30 which can make it attractive as a souvenir or fan item for the casual athletes when emblazoned with professional sport logos, colors, designs, and the like. These indicia identifiers, for example, can be mounted by hook-and-loop type fasteners to the outer surface of the elongate strap 31.

As best illustrated in FIGS. 7–11, a second embodiment of an athletic sock garter 30' preferably has an elongate strap 31' which includes a medial elastic portion and first and second inelastic end portions. For brevity purposes, many of elements of the garter 30' of the second embodiment which are like the first embodiment will not be further described in detail herein. The elongate strap 31' of the second embodiment also flexibly adjusts to movement associated with a wearer's leg L and allows blood to continue to readily circulate to the wearer's leg L when the garter 30' is positioned thereon. This second embodiment, like the first embodiment, has only a portion of the strap 31' formed of elastic material. A second end portion of the strap 31' preferably has hook fastener material 39' connected to or integrally formed as a unitary piece with the material forming that portion of the strap 31'. This second embodiment has four portions or sections of the strap 31', but at least the portion of the strap 31' adjacent the hook portion should be formed of pile or loop fastening material. As illustrated, other portions of the strap 31' advantageously can be formed of pile material as well to further provide adhesion or friction for portions of the sock folded so as to overlie the garter 30'.

By having only a predetermined portion of the strap 31' formed of an elastic material, the strap 31' also reduces digging into the skin of the wearer's leg L which can sometimes occur when elastic material surrounds the wearer's leg. An example of such a strap could be a user using rubber bands, as described in the background section above, around the leg portion of a sock to support the leg portion of the sock on the wearer's leg. These all elastic straps additionally can cut off or greatly inhibit blood circulation to an athlete's legs and feet.

In contrast, each of the first and second embodiments of an elongate strap 31, 31' of a garter 30, 30' according to the present invention has only a portion thereof formed of elastic material so that the digging into the skin and cutting off or inhibiting blood circulation to the wearer's legs and feet is greatly reduced. The first embodiment of the garter 30 has the elastic portion 35 at the first end 36 of the strap 31 and connected to the ring member 41 to, in essence, form a part of the adjustable fastening means 40. The second embodiment of the garter 30' has the elastic portion 35' formed in a medial portion of the strap 31' so that the elastic portion 35' will be positioned on a rearward part of the leg L of a wearer and overlying the calf muscle of the leg L. This position of the elastic portion 35' advantageously allows for flexible adjustment of the strap and allows the garter 30' to compensate for muscle flexing and movement during an athletic event. Yet, unlike all elastic straps such as rubber bands, this position of the elastic portion 35' of the strap 31' advantageously does not inhibit effective blood circulation to the legs and feet of wearers.

As best illustrated in FIGS. 12–16, a third embodiment of a garter 30" according to the present invention can include an elongate strap 31" having at least major portions thereof formed of elastic material having a predetermined range of elasticity so as to provide support for the leg portion 28 of the sock 25 without significantly impeding blood circulation through the leg L of the wearer. To accomplish this result, the elastic material of the elongate strap 31" preferably also has a minimum stretch in the range of about 80–90%, e.g., 85%, of the relaxed length without curling and a full recovery after a maximum stretch. The same elastic portion 35 of the elongate strap 31 can also be formed of a rubber material. This elastic material, however, preferably has more polyester or nylon material content. This elastic material also preferably has the hook type fastener material formed on a portion thereof and the pile or loop type fastener material formed on other portions thereof. These fastener materials preferably are integrally formed with the elastic or rubber/polyester portion. Likewise, for brevity purposes, many of elements of the garter 30" of the third embodiment which are like the first and/or second embodiments will not be further described in detail herein.

Because the advantageous of the construction of the straps 31, 31' of the first and second embodiments are not maintained in the third embodiment of the strap 31", the minimum amount of recovery acceptable for this third embodiment should be less as described above and the amount of rubber material content can be reduced, e.g., no longer required to be greater than the elastic material content. By forming the strap 31" of mostly elastic material, reducing the rubber material content, and reducing the minimum recovery that is acceptable, more emphasis then shifts to the benefits of the adjustable fastener 40" as described with respect to the first and second embodiments of the garter 30, 30'.

This combination of the elastic strap 31" and the adjustable fastener 40" of the third embodiment of a garter 30' can rely more on the wearer's feel and skill for the adjustable positioning of the garter 30", but advantageously provides a more even tension around the wearer's leg L and a more comfortable fit. Because the hook and pile fastener material 38", 39" is preferably integrally formed with the elastic and rubber portion, this third embodiment of an athletic sock garter 30" also can be easier and less expensive to manufacture.

As illustrated in FIGS. 1–16, the present invention also provides methods of using an athletic sock garter 30 for supporting a leg portion 28 of an athletic sock 25 during athletic events where the legs of the wearer are heavily used. A method preferably includes encircling a portion of a sock wearer's leg L when an athletic sock 25 is positioned thereon with an elongate strap 31 having a ring member 41 connected to a first end 36 thereof so that an inner surface 32 of the elongate strap 31 abuttingly contacts a leg portion 28 of the sock 25. A second end 37 of the elongate strap 31 is inserted through the ring member 41. A hook fastener portion 39 of the elongate strap 31 is folded so as to overlie and positionally align with a pile fastener portion 38 of the elongate strap 31 to matingly fasten therewith. The elongate strap 31 can then be adjustably positioned around the leg portion 28 of the sock 25 when positioned on the wearer's leg L and adjustably fastened about the leg portion 28 of the sock 25 when positioned at a desired location on a wearer's leg L.

Another method of using an athletic sock garter 30 for supporting a leg portion 28 of an athletic sock 25 during athletic events where the legs of the wearer are heavily used preferably includes encircling a portion of a sock wearer's leg L when an athletic sock 25 is positioned thereon with an elongate strap 31 having only a portion thereof formed of an elastic material so that an inner surface 32 of the elongate strap 31 abuttingly contacts a leg portion 28 of the sock 25. The elastic material preferably has a predetermined range of elasticity so as to provide support for the leg portion 28 of the sock 25 without significantly impeding blood circulation through the leg L. The elongate strap 31 is adjustably positioned around the leg portion 28 of the sock 25 when positioned on the wearer's leg L so as to stretch the elastic portion of the elongate strap 31. The elongate strap 31 can then be adjustably fastened about the leg portion 28 of the sock 25 when positioned at a desired location on a wearer's leg L.

These methods of the present invention can also include inhibiting slippage of the inner surface 32 of the garter 30 with outer leg portions 28 of a wearer's sock 25. A portion of the elongate strap 31 can also be removed from the second end 37 thereof so as to define a new second end so that the length of the elongate strap 31 can be adjusted, e.g., reduced, for various sized legs of wearers thereof.

The athletic sock garter 30, 30', 30' and methods of the present invention therefore advantageously maintain a leg portion 28 of a wearer's sock 25 in a secure position on the wearer's leg L even during heavy athletic use. The athletic sock garter 30 provides a cost effective device that compensates for the heavy use of the calf muscle during athletic events by use of a combination of an adjustable fastener 40, elastic material 35, and inelastic material. By having portions of the elongate strap 31 that readily break away such as by cutting or separating, the garter 30, 30', 30" also advantageously provides a one-size-fits-all type garter 30, 30', 30" that readily adapts and adjusts to various legs of athletes. The garter 30, 30', 30" additionally is inexpensive, easy to manufacture, and yet an effective garter 30, 30', 30" for these athletic purposes does not cut off effective blood circulation to the leg L of the wearer.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An athletic sock garter for supporting a leg portion of an athletic sock during athletic events where the legs of the wearer are heavily used, the athletic sock garter comprising:

an elongate strap arranged for encircling a portion of a sock wearer's leg when an athletic sock is positioned thereon so that an inner surface of said elongate strap abuttingly contacts a leg portion of the sock, said elongate strap being formed of means for elastically stretching within a predetermined range of elasticity so as to provide support for the leg portion of the sock without significantly impeding blood circulation through the leg; and means connected to said elongate strap for adjustably fastening said elongate strap about the sock when positioned on a wearer's leg, said adjustable fastening means comprising a ring member connected to a first end of the elongate strap, a pile fastener material secured to a portion of the outer surface of said elongate strap, and a mating hook fastener material secured to a portion of the outer surface of said elongate strap extending closely adjacent a second end thereof toward the first end of said elongate strap, whereby insertion of the second end of said elongate strap through said ring member and folding the hook fastener portion of said elongate strap so as to overlie and positionally align with said pile fastener portion for matingly fastening therewith provides adjustable positioning of said elongate strap around the leg portion of the sock when positioned on the wearer's leg.

2. An athletic sock garter as defined in claim 1, further comprising sock slippage inhibiting means connected to the inner surface of said elongate strap for abuttingly contacting and inhibiting slippage of the garter with outer portions of a wearer's sock.

3. An athletic sock garter as defined in claim 2, wherein said strap has at least portions thereof formed of a plastic material, and wherein said sock slippage inhibiting means comprises an elongate strip of hook material extending lengthwise along the inner surface of the plastic portions of said elongate strap.

4. An athletic sock garter as defined in claim 1, wherein said ring member of said adjustable fastening means is formed of a plastic material, a proximal end portion of said plastic ring member being connected to the first end of said elongate strap, and a distal end portion of said plastic ring member extending inwardly toward said proximal end portion for providing enhanced leverage for a quick, secure, and comfortable adjustment to the fastening of said adjustable fastening means.

5. An athletic sock garter as defined in claim 1, wherein said ring member of said adjustable fastening means has an elongate proximal end, an elongate distal end, and a pair of elongate sides, each of said pair of elongate sides extending between and being connected to said proximal and distal ends, wherein said elongate sides extending generally parallel to each other, and wherein said proximal end extends outwardly toward the first end of said elongate strap and said distal end extends inwardly toward said proximal end for providing a quick and secure adjustment to the fastening of said adjustable fastening means.

6. An athletic sock garter as defined in claim 1, wherein the means for elastically stretching of said elongate strap has a minimum stretch in the range of about 80–90 percent of the relaxed length without curling.

7. An athletic sock garter as defined in claim 1, wherein said elongate strap is further formed of a rubber material so that said elongate strap has more rubber material content than elastic material content.

8. An athletic sock garter as defined in claim 1, wherein said strap has first and second portions, said first portion being formed of elastic material and having an end thereof defining the first end of said strap and being connected to said ring member, said second portion being formed of non-elastic material so that said elongate strap flexibly adjusts to movement associated with a wearer's leg and allows blood to continue to readily circulate to the wearer's legs when the garter is positioned thereon.

9. An athletic sock garter as defined in claim 1, wherein said elongate strap has a medial elastic portion and first and second inelastic end portions so that said elongate strap flexibly adjusts to movement associated with a wearer's leg and allows blood to continue to readily circulate to the wearer's legs when the garter is positioned thereon.

10. An athletic sock garter for supporting a leg portion of an athletic sock during athletic events where the legs of the wearer are heavily used, the athletic sock garter comprising:

an elongate strap arranged for encircling a port ion of a sock wearer's leg when an athletic sock is positioned thereon so that substantially an entire inner surfaces of said elongate strap abuttingly contacts a leg portion of the sock, said elongate strap having at least a portion thereof formed of means for elastically stretching within a predetermined range of elasticity so as to provide support for the leg sock without significantly impeding blood circulation through the leg, said elongate strap also having at least one other portion formed of an inelastic material;

a sock slippage inhibitor connected to the inner surface of said elongate strap for abuttingly contacting and inhibiting slippage of said elongate strap with outer portions of a wearer's sock; and an adjustable fastener connected to said elongate strap for adjustably fastening said elongate strap about the sock when positioned on a wearer's leg, said adjustable fastener comprising a ring member connected to a first end of the elongate strap, a pile fastener material secured to a portion of the outer surface of said elongate strap, and a mating hook fastener material secured to a portion of the outer surface of said elongate strap extending closely adjacent a second end thereof toward the first end of said elongate strap, whereby insertion of the second end of said elongate strap through said ring member and folding the hook fastener portion of said elongate strap so as to overlie and positionally align with said pile fastener portion for matingly fastening therewith provides adjustable positioning of said elongate strap around the leg portion of the sock when positioned on the wearer's leg.

11. An athletic sock garter as defined in claim 10, wherein said sock slippage inhibitor comprises an elongate strip of hook material connected to and extending lengthwise along a medial portion of said elongate strap.

12. An athletic sock garter as defined in claim 11, wherein said ring member of said adjustable fastening means is formed of a plastic material, a proximal end portion of said plastic ring member being connected to the first end of said elongate strap, and a distal end portion of said plastic ring member extending inwardly toward said proximal end portion for providing enhanced leverage for a quick, secure, and comfortable adjustment to the fastening of said adjustable fastening means.

13. An athletic sock garter as defined in claim 12, wherein said ring member of said adjustable fastening means has an elongate proximal end, an elongate distal end, and a pair of elongate sides, each of said pair of elongate sides extending between and being connected to said proximal and distal ends, wherein said elongate sides extending generally parallel to each other, and wherein said proximal end extends outwardly toward the first end of said elongate strap and said distal end extends inwardly toward said proximal end for providing a quick and secure adjustment to the fastening of said adjustable fastening means.

14. An athletic sock garter as defined in claim 13, wherein the means for elastically stretching of said elongate strap has a minimum stretch in the range of about 80–90 percent of the relaxed length without curling.

15. An athletic sock garter as defined in claim 14, wherein said elastic strap is further formed of a rubber material so that said elastic strap has more rubber material content than elastic material content.

16. An athletic sock garter as defined in claim 15, wherein said strap has first and second portions, said first portion being formed of elastic material and having an end thereof defining the first end of said strap and being connected to said ring member, said second portion being formed of non-elastic material so that said elongate strap flexibly adjusts to movement associated with a wearer's leg and allows blood to continue to readily circulate to the wearer's legs when the garter is positioned thereon.

17. An athletic sock garter as defined in claim 16, wherein said elongate strap has a medial elastic portion and first and second inelastic end portions so that said elongate strap flexibly adjusts to movement associated with a wearer's leg and allows blood to continue to readily circulate to the wearer's legs when the garter is positioned thereon.

18. A combination athletic sock and athletic sock garter, the combination comprising:

an athletic sock arranged to be positioned on a wearer's leg, said sock including a leg portion and a foot portion; and an athletic sock garter associated with said athletic sock for supporting said leg portion of said sock when positioned on a wearer's leg, said garter including at least a portion thereof formed of means for elastically stretching within a predetermined range of elasticity so as to provide support for said leg portion of said sock without significantly impeding blood circulation through the wearer's leg and means for adjustably fastening said garter when positioned at a desired location on a wearer's leg.

19. A combination as defined in claim 18, wherein said adjustable fastening means of said garter includes a ring member connected to a first end of said garter, a pile fastener material secured to a portion of the outer surface of said garter, and a mating hook fastener material secured to a portion of the outer surface of said garter extending closely adjacent a second end thereof toward the first end of said garter, whereby insertion of the second end of said garter through said ring member and folding the hook fastener portion of said elongate strap so as to overlie and positionally align with said pile fastener portion for matingly fastening therewith provides adjustable positioning of said garter around said leg portion of said sock when positioned on the wearer's leg.

20. A combination as defined in claim 19, wherein said ring member of said adjustable fastening means of said garter is formed of a plastic material, a proximal end portion of said plastic ring member being connected to the first end of said garter, and a distal end portion of said plastic ring member extending inwardly toward said proximal end portion for providing enhanced leverage for a quick, secure, and comfortable adjustment to the fastening of said adjustable fastening means.

21. A combination as defined in claim 20, wherein said ring member of said adjustable fastening means of said garter has an elongate proximal end, an elongate distal end, and a pair of elongate sides, each of said pair of elongate sides extending between and being connected to said proximal and distal ends, wherein said elongate sides extending generally parallel to each other, and wherein said proximal end extends outwardly toward the first end of said garter and said distal end extends inwardly toward said proximal end for providing a quick and secure adjustment to the fastening of said adjustable fastening means.

22. A combination as defined in claim 21, wherein the means for elastically stretching of said garter has a minimum stretch in the range of about 80–90 percent of the relaxed length without curling.

23. An athletic sock garter as defined in claim 22, wherein said garter is further formed of a rubber material so that said garter has more rubber material content than elastic material content.

24. A method of using an athletic sock garter for supporting a leg portion of an athletic sock during athletic events where the legs of the wearer are heavily used, the method comprising:

encircling a portion of a sock wearer's leg when an athletic sock is positioned thereon with an elongate strap having a ring member connected to a first end thereof so that substantially an entire inner surface of the elongate strap abuttingly contacts a leg portion of the sock;

inserting a second end of the elongate strap through the ring member;

folding a hook fastener portion of the elongate strap so as to overlie and positionally align with a pile fastener portion of the elongate strap to matingly fasten therewith;

adjustably positioning the elongate strap around the leg portion of the sock when positioned on the wearers leg so as to provide support for the leg portion through the wearer's leg; and adjustably fastening the elongate strap about the sock when positioned at a desired location on a wearer's leg.

25. A method as defined in claim 24, further comprising inhibiting slippage of the inner surface of the garter with outer portions of a wearer's sock.

26. A method of using an athletic sock garter for supporting a leg portion of an athletic sock during athletic events where the legs of the wearer are heavily used, the method comprising:

encircling a portion of a sock wearer's leg when an athletic sock is positioned thereon with an elongate strap having only a portion thereof formed of an elastic material so that substantially an entire inner surface of the elongate strap abuttingly contacts a leg portion of the sock, the elastic material having a predetermined range of elasticity so as to provide support for the sock without significantly impeding blood circulation through the leg;

adjustably positioning the elongate strap around the leg portion of the sock when positioned on the wearers leg so as to stretch the elastic portion of the elongate strap; and adjustably fastening the elongate strap about the sock when position ed at a desired location on a wearer's leg.

27. A method as defined in claim 26, further comprising inhibiting slippage of the inner surface of the garter with outer portions of a wearer's sock.

* * * * *